US010609979B1

(12) United States Patent
Gallo

(10) Patent No.: US 10,609,979 B1
(45) Date of Patent: Apr. 7, 2020

(54) ADJUSTABLE SAFETY HELMET FOR MOTORSPORTS

(71) Applicant: Gerald F. Gallo, Worcester, MA (US)

(72) Inventor: Gerald F. Gallo, Worcester, MA (US)

( * ) Notice: Subject to any disclaimer, the term of this patent is extended or adjusted under 35 U.S.C. 154(b) by 234 days.

(21) Appl. No.: 15/702,857

(22) Filed: Sep. 13, 2017

(51) Int. Cl.

| | |
|---|---|
| ***A42B 3/32*** | (2006.01) |
| ***A63B 71/10*** | (2006.01) |
| ***A42B 3/22*** | (2006.01) |
| ***A42B 3/12*** | (2006.01) |
| ***A42B 3/06*** | (2006.01) |

(52) U.S. Cl.
CPC ..... *A42B 3/324* (2013.01); *A42B 3/063* (2013.01); *A42B 3/125* (2013.01); *A42B 3/22* (2013.01); *A63B 71/10* (2013.01)

(58) Field of Classification Search
CPC ..... A42B 3/324; A42B 3/063; A42B 3/125; A42B 3/22; A42B 3/322; A42B 3/32; A42B 3/326; A42B 3/328; A42B 3/00; A63B 71/10
USPC ..... 2/412, 410, 6.1, 6.2, 417, 418, 420, 422
See application file for complete search history.

(56) References Cited

U.S. PATENT DOCUMENTS

| | | | | |
|---|---|---|---|---|
| 6,324,700 | B1 | 12/2001 | McDougall | |
| 8,146,177 | B2 * | 4/2012 | Mangone | A42B 3/324 2/410 |
| 8,448,266 | B2 | 5/2013 | Alexander | |
| 8,667,618 | B2 * | 3/2014 | Pierini | A42B 3/326 2/411 |
| 8,832,870 | B2 | 9/2014 | Belanger | |

* cited by examiner

*Primary Examiner* — Anna K Kinsaul
*Assistant Examiner* — F Griffin Hall

(57) ABSTRACT

The adjustable safety helmet for motorsports is an item of personal protective equipment. The adjustable safety helmet for motorsports is configured for use in activities involving high velocities including riding motorcycles. More specifically, the adjustable safety helmet for motorsports is a motorcycle helmet. The adjustable safety helmet for motorsports comprises a protective structure, a plurality of rack and pinions, and a plurality of resistance springs. The protective structure further comprises an anterior structure and a posterior structure. The plurality of rack and pinions and the plurality of resistance springs are installed within the protective structure such that: 1) the anterior structure and the posterior structure separate when the protective structure is donned; and, 2) the anterior structure and the posterior structure join to create the protected environment of the adjustable safety helmet for motorsports.

2 Claims, 7 Drawing Sheets

ADJUSTABLE SAFETY HELMET FOR MOTORSPORTS

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of personal and domestic articles including headwear, more specifically, an adjustable helmet made of separable parts.

SUMMARY OF INVENTION

The adjustable safety helmet for motorsports is an item of personal protective equipment. The adjustable safety helmet for motorsports is configured for use in activities involving high velocities including riding motorcycles. More specifically, the adjustable safety helmet for motorsports is a motorcycle helmet. The adjustable safety helmet for motorsports comprises a protective structure, a plurality of rack and pinions, and a plurality of resistance springs. The protective structure further comprises an anterior structure and a posterior structure. The plurality of rack and pinions and the plurality of resistance springs are installed within the protective structure such that: 1) the anterior structure and the posterior structure separate when the protective structure is donned; and, 2) the anterior structure and the posterior structure join to create the protected environment of the adjustable safety helmet for motorsports.

These together with additional objects, features and advantages of the adjustable safety helmet for motorsports will be readily apparent to those of ordinary skill in the art upon reading the following detailed description of the presently preferred, but nonetheless illustrative, embodiments when taken in conjunction with the accompanying drawings.

In this respect, before explaining the current embodiments of the adjustable safety helmet for motorsports in detail, it is to be understood that the adjustable safety helmet for motorsports is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the adjustable safety helmet for motorsports.

It is therefore important that the claims be regarded as including such equivalent construction insofar as they do not depart from the spirit and scope of the adjustable safety helmet for motorsports. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

Figure 1:
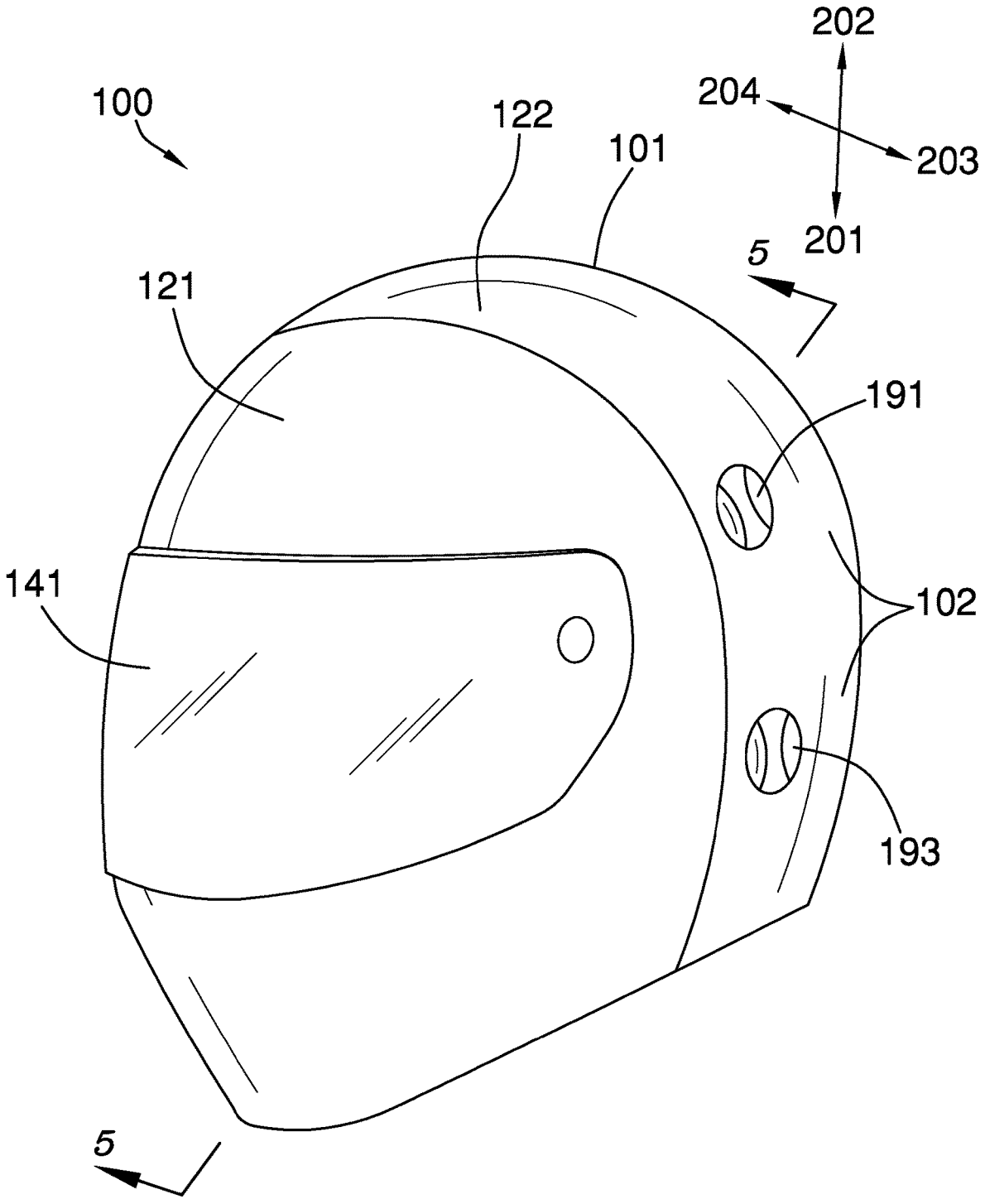
FIG. 1 is a perspective view of an embodiment of the disclosure.
Figure 2:
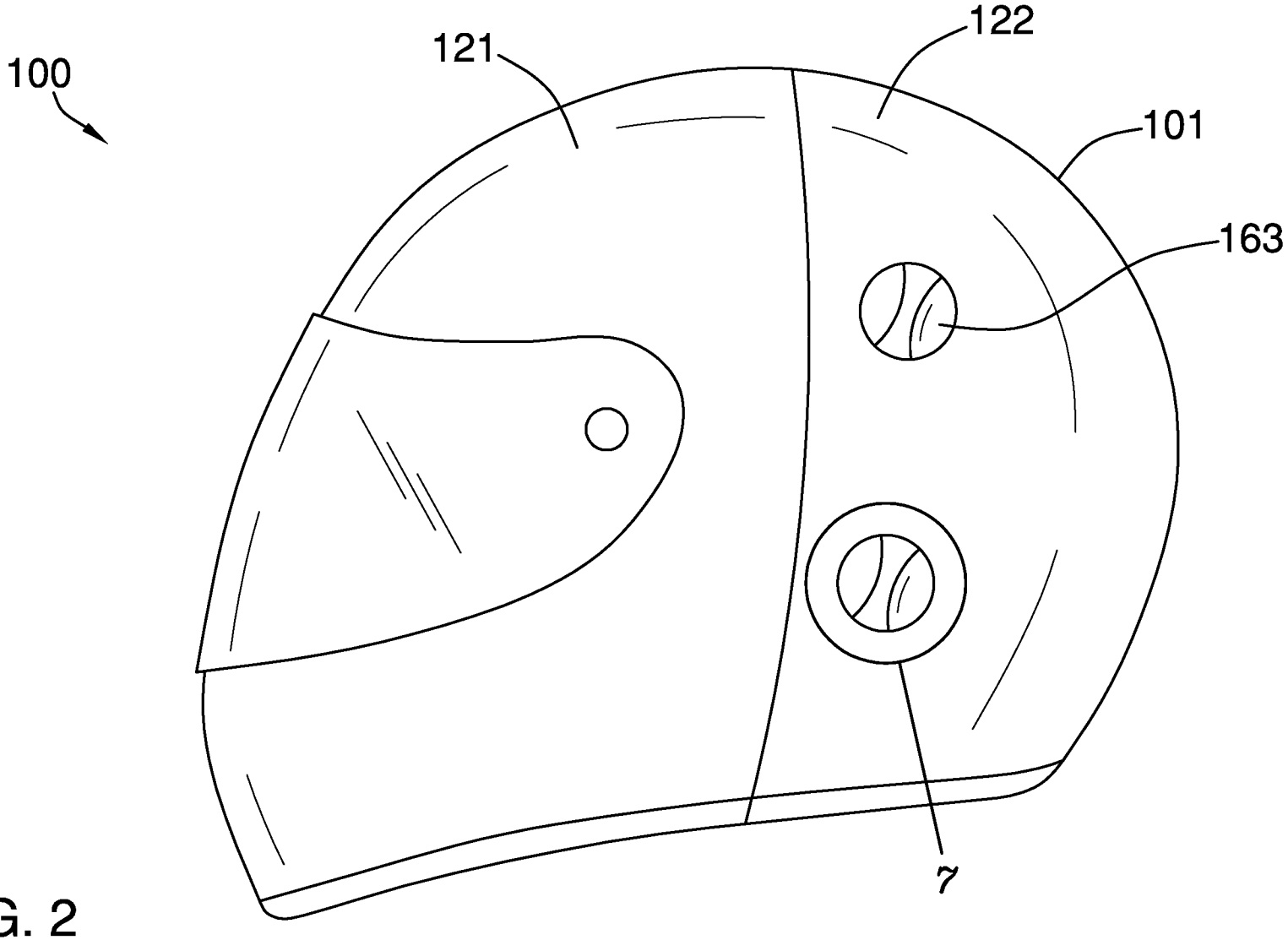
FIG. 2 is a side view of an embodiment of the disclosure.
Figure 3:
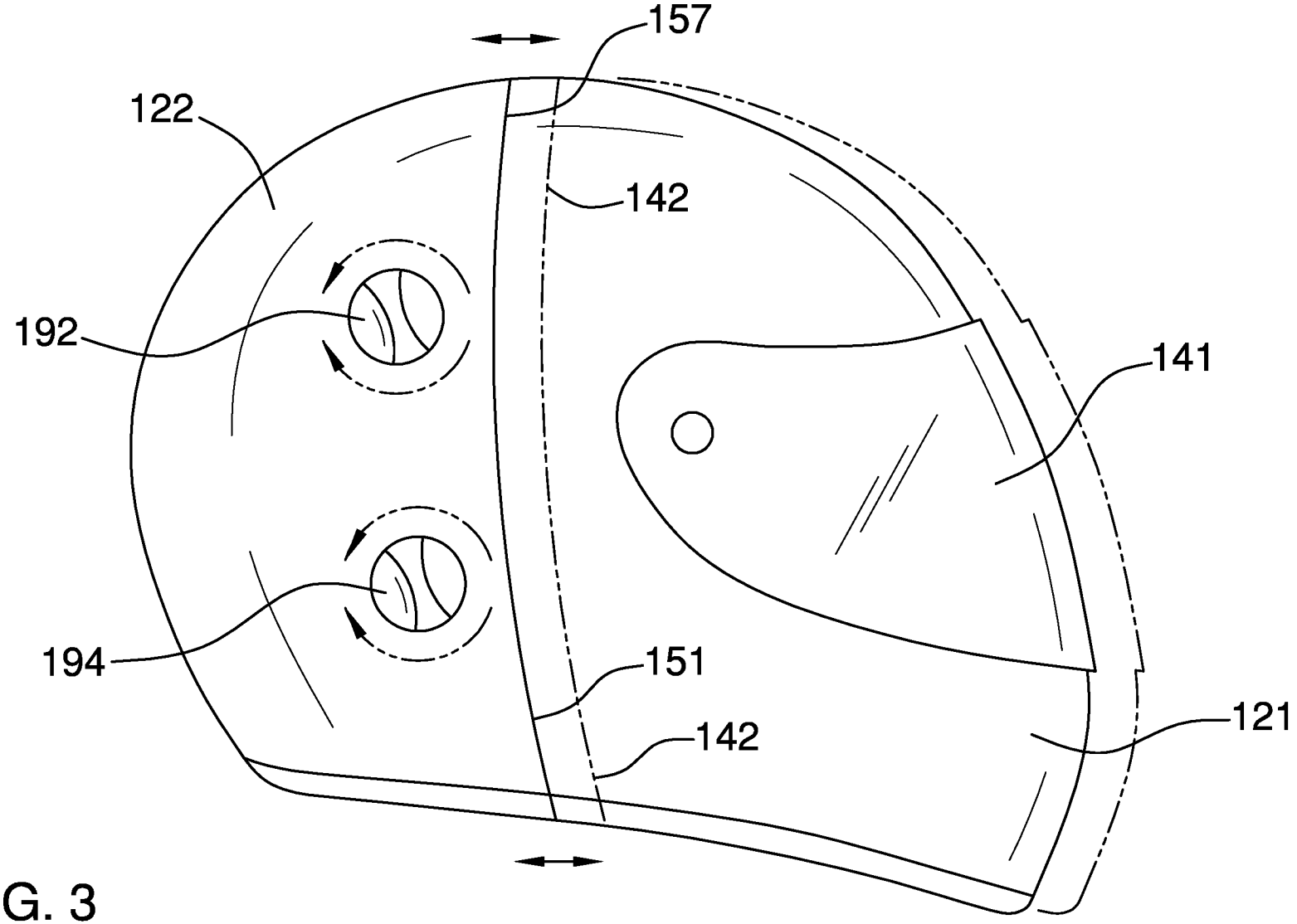
FIG. 3 is an opposite side view of an embodiment of the disclosure.

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Detailed reference will now be made to one or more potential embodiments of the disclosure, which are illustrated in FIGS. 1 through 7.

The adjustable safety helmet for motorsports 100 (hereinafter invention) is an item of personal protective equipment. The invention 100 is configured for use in activities involving high velocities including riding motorcycles. More specifically, the invention 100 is a motorcycle helmet. The invention 100 comprises a protective structure 101, a plurality of rack and pinions 102, and a plurality of resistance springs 103. The protective structure 101 further comprises an anterior structure 121 and a posterior structure 122. The plurality of rack and pinions 102 and the plurality of resistance springs 103 are installed within the protective structure 101 such that: 1) the anterior structure 121 and the posterior structure 122 separate when donning the protective structure 101; and, 2) the anterior structure 121 and the posterior structure 122 join to create the protected environment of the invention 100.

The protective structure 101 forms the shell which contains a user's head. The protective structure 101 creates a space that protects the user's head from impact injury. Methods to form the protective structure 101 of a motorcycle helmet are well-known and documented in the mechanical arts.

The protective structure 101 comprises an impact shell 111, an impact foam 112, and a comfort foam 113.

The impact shell 111 is a rigid structure that forms the exterior surface of the protective structure 101. The impact shell 111 receives the initial impact force generated by an unfortunate event. The rigid structure of the impact shell 111 distributes the impact force received by the protective structure 101 over the entire surface area of the protective structure 101. The impact shell 111 thereby reduces the peak pressure experienced by the user's head.

The impact foam 112 is a sacrificial foam attached to the interior surfaces of the impact shell 111. The impact foam 112 is a semi-rigid structure. The semi-rigid structure of the impact foam 112 causes the impact foam 112 to deform in response to the initial impact. This deformation of the impact foam 112 dissipates the energy of the initial impact thereby protecting the user's head.

The comfort foam 113 is a padded liner that attaches to the surface of the impact foam 112 located distally from the impact shell 111. The comfort foam 113 cushions the user's head from the impact foam 112 and the impact shell 111 while the invention 100 is in use.

The protective structure 101 further comprises an anterior structure 121 and a posterior structure 122. The protective structure 101 is bifurcated into the posterior structure 122 and the anterior structure 121 at a coronal plane 181. The coronal plane 181 is the plane that separates the protective structure 101 into the anterior structure 121 and the posterior structure 122 along a path that is parallel to a line formed in the dexter 203 and sinister 204 directions.

The anterior structure 121 is the structure of the protective structure 101 that encloses and protects the anterior side of the user's head. The anterior structure 121 is identified by the face plate 141. The face plate 141 is an aperture and a shield that: 1) allows the user to see through the anterior structure 121; and, 2) forms a windbreak that protects the user while the user is in motion. The anterior structure 121 further comprises an anterior mounting edge 142. The anterior mounting edge 142 is the perimeter of the opening formed in the anterior structure 121 by the bifurcation of the protective structure 101 along the coronal plane 181.

The posterior structure 122 is the structure of the protective structure 101 that encloses and protects the posterior side of the user's head. The posterior structure 122 is identified by the plurality of rack and pinions 102. The posterior structure 122 further comprises a posterior mounting edge 151. The posterior mounting edge 151 is the perimeter of the opening formed in the posterior structure 122 by the bifurcation of the protective structure 101 along the coronal plane 181.

The user's head is properly enclosed within the protective structure 101 when the posterior mounting edge 151 is seated under tension against the anterior mounting edge 142.

Each of the plurality of rack and pinions 102 attaches the posterior structure 122 to the anterior structure 121. Each individual rack and pinion 160 selected from the plurality of rack and pinions 102 are identical. Each individual rack and pinion 160 converts the rotation of the pinion 162 into a linear motion of the rack 161. The linear motion of the rack 161 adjusts the span of the separation between the posterior structure 122 and the anterior structure 121. To don the invention 100, each of the plurality of rack and pinions 102 is positioned to maximize the separation between the posterior structure 122 and the anterior structure 121. Once the invention 100 is donned, each of the plurality of rack and pinions 102 is adjusted such that the head of the user is completely enclosed by the protective structure 101.

The plurality of rack and pinions 102 comprises a collection of individual rack and pinions 160. Each of the plurality of rack and pinions 102 are identical.

The individual rack and pinion 160 is a well-known and documented mechanical device that converts rotational motion into linear motion. The use of an individual rack and pinion 160 is well-known and documented in the mechanical arts. The individual rack and pinion 160 attaches the posterior structure 122 to the anterior structure 121 such that the individual rack and pinion 160 can increase or decrease the span of the separation between the posterior structure 122 and the anterior structure 121.

Each individual rack and pinion 160 comprises a rack 161, a pinion 162, and a pinion dial 163.

Figure 4:
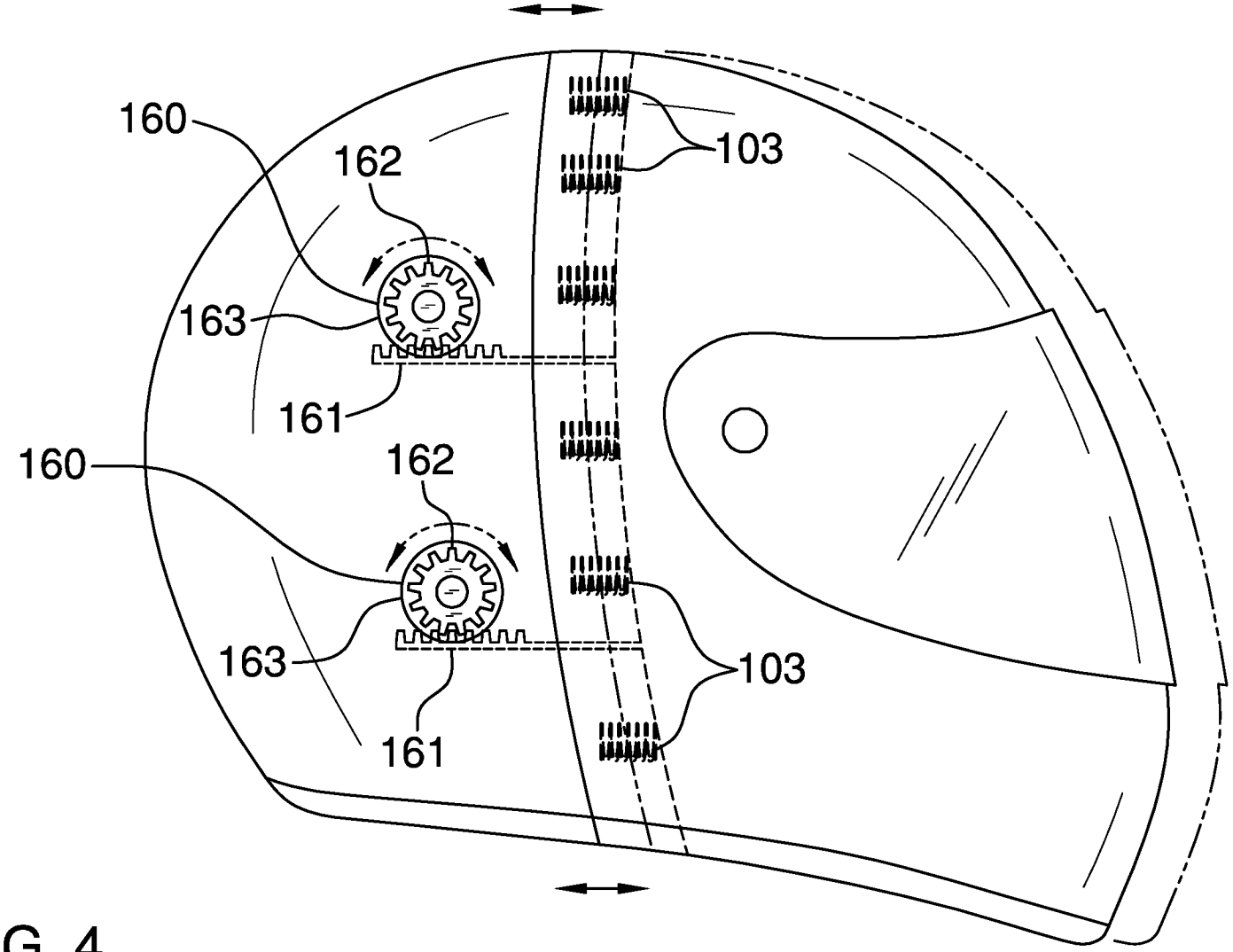
FIG. 4 is a detail view of an embodiment of the disclosure.
Figure 5:
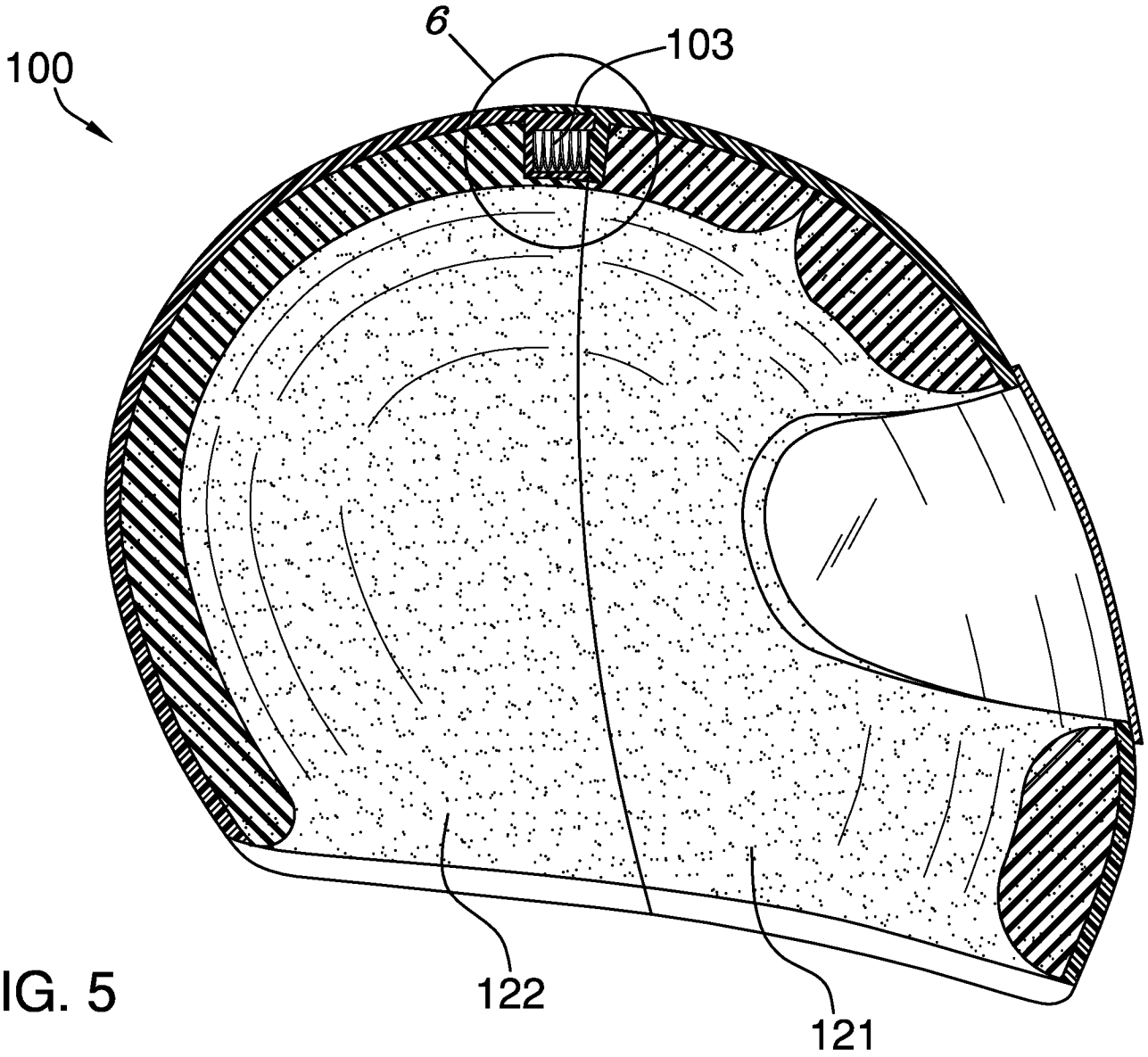
FIG. 5 is a cross-sectional view of an embodiment of the disclosure across 5-5 as shown in FIG. 1.
Figure 6:
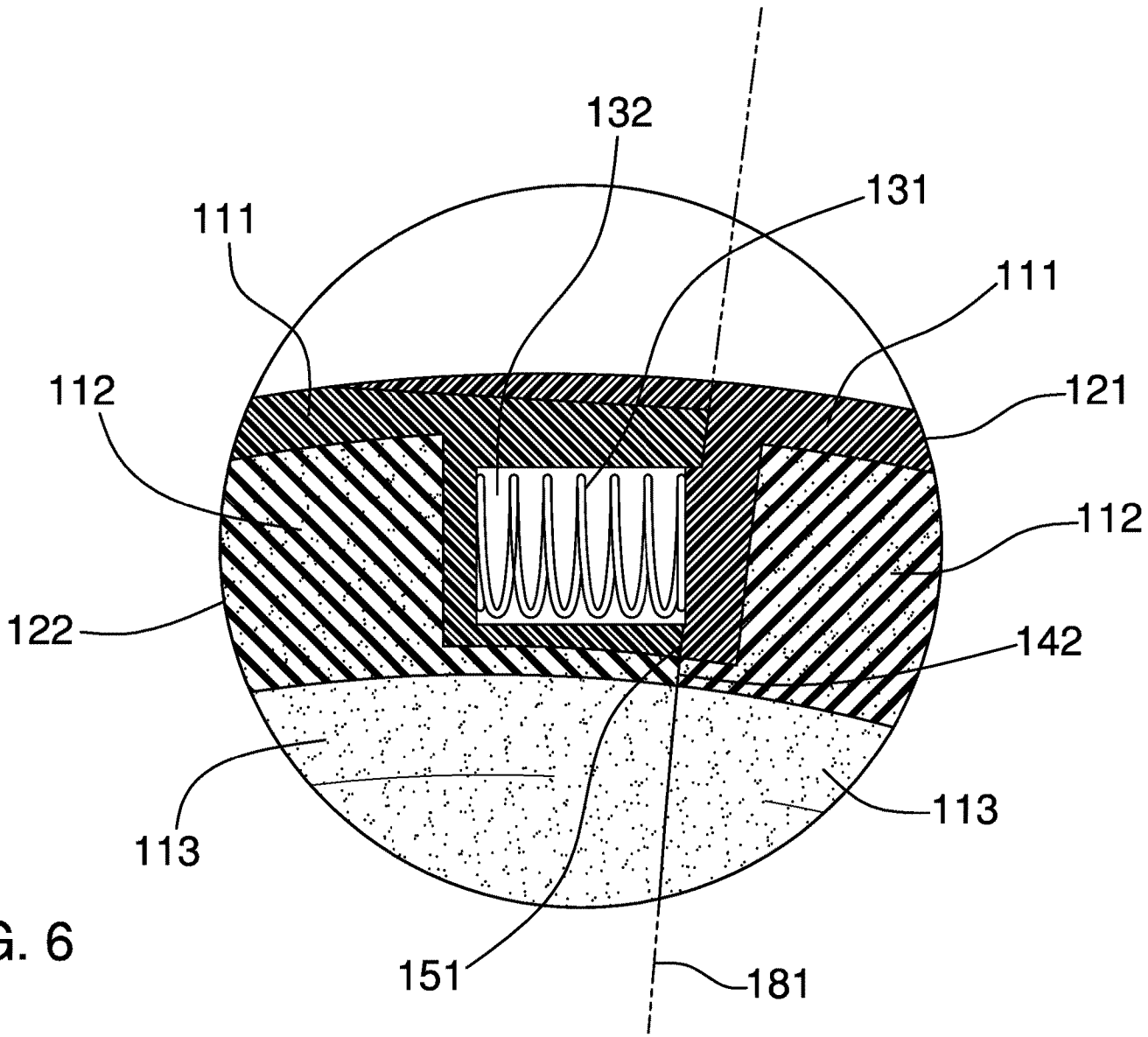
FIG. 6 is a detail view of figure element cross-reference 6 as shown in FIG. 5.

As shown most clearly in FIG. 4, the rack 161 is a toothed plate structure that attaches in the manner of a cantilever to the anterior mounting edge 142 of the anterior structure 121. The rack 161 projects away from the anterior mounting edge 142 in the direction of the posterior mounting edge 151. The rack 161 inserts into a cavity formed within the posterior mounting edge 151 of the posterior structure 122 such that the rack 161 is captured within the posterior structure 122 by the pinion 162.

The pinion 162 is a toothed circular gear structure commonly referred to as an involute gear. The pinion 162 rotates around a center axis. The pinion 162 interacts with the rack 161 such that the rotation of the pinion 162 linearly moves the rack 161. Because the pinion 162 attaches to the posterior structure 122 while the rack 161 attaches to the anterior structure 121, the motion of the rack 161 relative to the pinion 162 causes the span of the separation between the posterior structure 122 and the anterior structure 121 to change.

Figure 7:
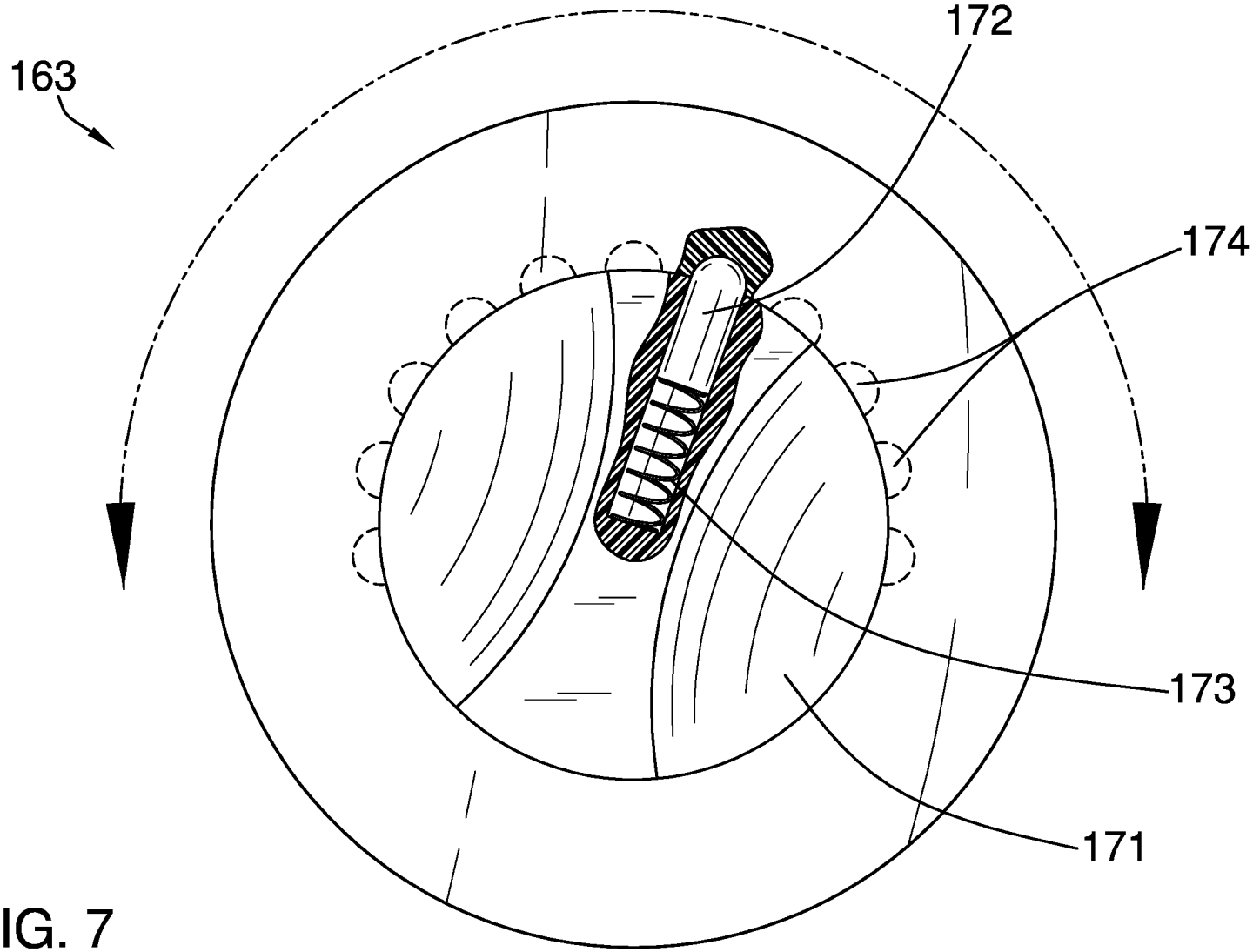
FIG. 7 is a detail view of figure element cross-reference 7 as shown in FIG. 2.

As shown most clearly in FIG. 7, the pinion dial 163 is an apparatus that: 1) attaches the pinion 162 to the posterior structure 122; 2) rotates the pinion 162 relative to the rack 161; and, 3) locks the pinion 162 in a fixed position once the proper relative position of the posterior structure 122 to the anterior structure 121 has been set.

The pinion dial 163 further comprises a grip 171, a throw 172, a throw spring 173, and a plurality of throw notches 174.

The grip 171 is a disk shaped manual interface that attaches to the pinion 162 such that the rotation of the grip 171 rotates the pinion 162. The grip 171 is commonly referred to as a knob or a dial. The throw 172 is a cylinder installed within the grip 171. The throw spring 173 is a commercially available helical compression spring. The throw spring 173 attaches to the throw 172 such that the throw 172 will: 1) extend beyond the perimeter of the grip 171; and, 2) retract into the grip 171.

When the throw 172 extends beyond the perimeter of the grip 171, the throw 172 gets captured in a notch selected from the plurality of throw notches 174. The interaction between the selected notch and the plurality of throw notches 174 and the throw 172 effectively locks the pinion 162 in a position, which further locks the position of the posterior structure 122 relative to the anterior structure 121. In its relaxed shape, the throw spring 173 holds the throw 172 in the extended position beyond the perimeter of the grip 171.

The throw spring 173 compresses by pushing the throw 172 into the grip 171. With the throw 172 compressed within the grip 171, the grip 171 can rotate the pinion 162 such that the position of the posterior structure 122 can be adjusted relative to the anterior structure 121.

Each of the plurality of throw notches 174 is a notch formed within the posterior structure 122. Each of the plurality of throw notches 174 is sized to receive the throw 172. The interaction between the throw 172 and the selected notch is described elsewhere in this disclosure.

Methods to design and manufacture each of the plurality of rack and pinions 102 and the associated pinion dial 163 are well-known and documented in the mechanical arts.

The plurality of rack and pinions 102 further comprises a superior 202 sinister 204 rack and pinion 191, a superior 202 dexter 203 rack and pinion 192, an inferior 201 sinister 204 rack and pinion 193, and an inferior 201 dexter 203 rack and pinion 194.

The superior 202 sinister 204 rack and pinion 191 is an individual rack and pinion 160 located on the sinister 204 side of the posterior structure 122. The superior 202 dexter 203 rack and pinion 192 is an individual rack and pinion 160 located on the dexter 203 side of the posterior structure 122. The inferior 201 sinister 204 rack and pinion 193 is an individual rack and pinion 160 located on the sinister 204 side of the posterior structure 122. The inferior 201 dexter 203 rack and pinion 194 is an individual rack and pinion 160 located on the dexter 203 side of the posterior structure 122.

The superior 202 sinister 204 rack and pinion 191 is located in a superior position relative to the inferior 201 sinister 204 rack and pinion 193. The superior 202 dexter 203 rack and pinion 192 is located in a superior position relative to the inferior 201 dexter 203 rack and pinion 194.

Each of the plurality of resistance springs 103 is a spring that: 1) is positioned between the posterior structure 122 and the anterior structure 121; and, 2) resists the action of the plurality of rack and pinions 102 as the plurality of rack and pinions 102 encloses the protective structure 101 around the head of the user. The plurality of resistance springs 103: 1) provides tactile feedback through the individual rack and pinion 160 as the posterior structure 122 presses against the anterior structure 121; and, 2) provides a counter force during the seating of the posterior structure 122 against the anterior structure 121 that ensures that the posterior structure 122 seats properly against the anterior structure 121.

As shown most clearly in FIG. 4, each of the individual resistance spring 131 is a commercially available helical compression spring. Each of the individual resistance spring 131 is positioned between the posterior mounting edge 151 and the anterior mounting edge 142 such that a resistive force is generated by each of the individual resistance spring 131 as the posterior mounting edge 151 presses against the anterior mounting edge 142.

Each of the plurality of spring cavities 132 is a negative space formed into the posterior structure 122 through the posterior mounting edge 151. Each of the plurality of spring cavities 132 is formed in the shape of a cylinder. Each of the plurality of spring cavities 132 is sized such that a resistance spring selected from the individual resistance spring 131 can be inserted into a spring cavity selected from the plurality of spring cavities 132. Each of the individual resistance springs 131 are sized such that any resistance spring selected from the individual resistance spring 131 will extend beyond the posterior mounting edge 151 of the posterior structure 122 after the selected resistance spring has been inserted into a spring cavity selected from the plurality of spring cavities 132.

The following definitions were used in this disclosure:

Anterior: As used in this disclosure, anterior is a term that is used to refer to the front side or direction of an object. When comparing two objects, the anterior object is the object that is closer to the front of the object.

Bifurcate: As used in this disclosure, to bifurcate means to divide an object or space into two pieces or segments.

Cantilever: As used in this disclosure, a cantilever is a beam or other structure that projects away from an object and is supported on only one end. A cantilever is further defined with a fixed end and a free end. The fixed end is the end of the cantilever that is attached to the object. The free end is the end of the cantilever that is distal from the fixed end.

Compression Spring: As used in this disclosure, a compression spring is a wire coil that resists forces attempting to compress the wire coil in the direction of the center axis of the wire coil. The compression spring will return to its original position when the compressive force is removed.

Coronal Plane: As used in this disclosure, the coronal plane refers to a reference plane that bisects an anterior surface and posterior surface.

Cylinder: As used in this disclosure, a cylinder is a geometric structure defined by two identical flat and parallel ends, also commonly referred to as bases, which are circular in shape and connected with a single curved surface, referred to in this disclosure as the face. The cross section of the cylinder remains the same from one end to another. The axis of the cylinder is formed by the straight line that connects the center of each of the two identical flat and parallel ends of the cylinder. Unless otherwise stated within this disclosure, the term cylinder specifically means a right cylinder which is defined as a cylinder wherein the curved surface perpendicularly intersects with the two identical flat and parallel ends.

Disk: As used in this disclosure, a disk is a cylindrically shaped object that is flat in appearance.

Don: As used in this disclosure, to don means to enclose a person or object within a structure. For example, a person dons a helmet.

Gear: As used in this disclosure, a gear is a first toothed wheel, cylinder, or other toothed mechanical element that is used to transmit motion, a change of speed, or a change of direction to a second toothed wheel, cylinder, or other toothed mechanical element.

Grip: As used in this disclosure, a grip is an accommodation formed within an object that allows the object to be grasped or manipulated by a hand.

Helix: As used in this disclosure, a helix is the three-dimensional structure that would be formed by a wire that is wound uniformly around the surface of a cylinder or a cone. If the wire is wrapped around a cylinder, the helix is called a cylindrical helix. If the wire is wrapped around a cone, the helix is called a conical helix. A synonym for conical helix would be a volute.

Inferior: As used in this disclosure, the term inferior refers to a directional reference that is parallel to and in the same direction as the force of gravity.

Motorcycle: As used in this disclosure, a motorcycle is a commercially available motorized vehicle with wheels that is intended for carrying one or more passengers.

Motorcycle Helmet: As used in this disclosure, a motorcycle helmet is a piece of protective headgear that provides a chin bar to provide chin and lower face protection during an impact. Motorcycle helmets are worn to protect the users head during impacts. This definition is intended to explicitly include helmets beyond those worn by motorcycle riders including, but not limited to, helmets worn by alpine ski racers or race car drivers. This definition is intended to explicitly exclude "motorcycle" helmets without a chin bar such as "open face," "¾," or "half" helmets.

Notch: As used in this disclosure, a notch is: 1) an indentation formed in an edge; or 2) a cavity or aperture formed within a surface.

Personal Protective Equipment: As used in this disclosure, personal protective equipment refers to the use of protective garments or protective equipment that is designed to protect the wearer's body from injury. Personal protective equipment may be designed for occupational protection, including, but not limited to, equipment to protect military, police, or firefighting personnel, or may be designed to provide protection in sports or recreational activities, including, but not limited to, equipment to protect participants in football, hockey, or soccer activities.

Posterior: As used in this disclosure, posterior is a term that is used to refer to the side of an object that is distal or in the opposite direction of the anterior side. When comparing two items, the posterior item is the item that is distal from the front of the object.

Rack and Pinion: As used in this disclosure, a rack and pinion is a gearing system that is designed to convert rotational energy into linear energy or the reverse. The rack is a toothed shaft that moves in a linear manner. The pinion is a gear (generally mounted on a rotating shaft) that interacts with the rack such that when the pinion rotates the rack is moved in a linear direction. Reversing the direction of rotation of the pinion will reverse the direction of the rack. Rack and pinion systems are well-known and documented in the mechanical arts.

Relaxed Shape: As used in this disclosure, a structure is considered to be in its relaxed state when no shear, strain, or torsional forces are being applied to the structure.

Rigid Structure: As used in this disclosure, a rigid structure is a solid structure that is inflexible and will not deform before breaking under a force.

Semi-Rigid Structure: As used in this disclosure, a semi-rigid structure is a solid structure that is stiff but not wholly inflexible and that will deform under force before breaking. A semi-rigid structure may or may not behave in an elastic fashion in that a semi-rigid structure need not return to a relaxed shape.

Sinister: As used in this disclosure, sinister is a directional reference that refers to the left side of the body or the left side of an object from the perspective of a viewer who is facing the posterior side of the object.

Spring: As used in this disclosure, a spring is a device that is used to store mechanical energy. This mechanical energy will often be stored by: 1) deforming an elastomeric material that is used to make the device; 2) the application of a torque to a rigid structure; or 3) a combination of the previous two items.

Superior: As used in this disclosure, the term superior refers to a directional reference that is parallel to and in the opposite direction of the force of gravity.

Tradition: As used in this disclosure, a tradition refers to: 1) a set of thoughts or expectations regarding a subject or object; or, 2) a method of using an object; that, 3) is perceived to be widely or commonly shared across a population of people; and that, 4) is perceived to be widely or commonly shared across at least two generations within the population of people.

Vehicle: As used in this disclosure, a motorized vehicle is a device used for transporting passengers, goods, or equipment. The term motorized vehicle refers to a vehicle can move under power provided by an electric motor or an internal combustion engine.

With respect to the above description, it is to be realized that the optimum dimensional relationship for the various components of the invention described above and in FIGS. 1 through 7 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A personal protection device comprising: wherein the personal protection device comprises a protective structure, a plurality of rack and pinions, and a plurality of resistance springs; wherein the plurality of rack and pinions and the plurality of resistance springs are installed in the protective structure; wherein the personal protection device is a helmet; wherein the protective structure creates a protected space; wherein the protective structure further comprises an anterior structure and a posterior structure; wherein the plurality of rack and pinions and the plurality of resistance springs are installed within the protective structure such that the anterior structure and the posterior structure separate; wherein the plurality of rack and pinions and the plurality of resistance springs are installed within the protective structure such that the anterior structure and the posterior structure join to create the protected space; wherein the protective structure comprises an impact shell and an impact foam; wherein the impact shell is a rigid structure that forms the exterior surface of the protective structure; wherein the impact foam is a semi-rigid structure; wherein the protective structure is bifurcated at a coronal plane; wherein the coronal plane defines the boundary between the anterior structure and the posterior structure; wherein the anterior structure is the structure of the protective structure that encloses and protects the anterior side of protected space; wherein the posterior structure is the structure of the protective structure that encloses and protects the posterior side of protected space; wherein the anterior structure comprises a face plate; wherein the anterior structure further comprises an anterior mounting edge; wherein the anterior mounting edge is a perimeter of an opening formed in the anterior structure by the bifurcation of the protective structure along the coronal plane; wherein the posterior structure further comprises a posterior mounting edge; wherein the posterior mounting edge is a perimeter of an opening formed in the posterior structure by the bifurcation of the protective structure along the coronal plane; wherein each of the plurality of rack and pinions attaches the posterior structure to the anterior structure; wherein each individual rack and pinion converts the rotation of the pinion into a linear motion of the rack: wherein the linear motion of the rack adjusts a span of the separation between the posterior structure and the anterior structure; wherein each individual rack and pinion selected from the plurality of rack and pinions are identical; wherein each of the plurality of rack and pinions are identical: wherein the individual rack and pinion attaches the posterior structure to the anterior structure such that the individual rack and pinion increases or decreases a span of the separation between the posterior structure and the anterior structure: wherein each individual rack and pinion comprises a rack, a pinion, and a pinion dial; wherein the rack interacts with the pinion; wherein the pinion dial rotates the pinion; wherein the rack is a toothed plate structure wherein the pinion is an involute gear; wherein the pinion rotates around a center axis; wherein the rack attaches in the manner of a cantilever to the anterior mounting edge of the anterior structure; wherein the rack projects away from the anterior mounting edge in the direction of the posterior mounting edge; wherein the rack inserts into the posterior mounting edge of the posterior structure; wherein the pinion is mounted within the posterior structure; wherein the pinion rotates within the posterior structure; wherein the rack inserts into the posterior mounting edge of the posterior structure such that the rack is captured within the posterior structure by the pinion; wherein the pinion interacts with the rack such that the rotation of the pinion linearly moves the rack; wherein the linear motion of the rack relative to the pinion causes the span of the separation between the posterior structure and the anterior structure to change; wherein the pinion dial attaches the pinion to the posterior structure; wherein the pinion dial rotates the pinion relative to the rack; wherein the pinion dial locks the pinion in a fixed position; wherein the pinion dial further comprises a grip, a throw, a throw spring, and a plurality of throw notches; wherein the grip is a disk shaped manual interface that attaches to the pinion such that the rotation of the grip rotates the pinion; wherein the throw is a cylinder installed within the grip; wherein the throw spring is a helical compression spring; wherein the throw spring attaches to the throw such that the throw extends beyond the perimeter of the grip; wherein the throw is captured in a notch selected from the plurality of throw notches; wherein each of the plurality of throw notches is sized to receive the throw; wherein the plurality of rack and pinions further comprises a superior sinister rack and pinion, a superior dexter rack and pinion, an inferior sinister rack and pinion, and an inferior dexter rack and pinion; wherein the superior sinister rack and pinion is an individual rack and pinion located on a sinister side of the posterior structure; wherein the superior dexter rack and pinion is an individual rack and pinion located on a dexter side of the posterior structure; wherein the interior sinister rack and pinion is an individual rack and pinion located on the sinister side of the posterior structure; wherein the inferior dexter rack and pinion is an individual rack and pinion located on the dexter side of the posterior structure; wherein the superior sinister rack and pinion is located in a superior position relative to the inferior sinister rack and pinion; wherein the superior dexter rack and pinion is located in a superior position relative to the inferior dexter rack and pinion.

2. The personal protection device according to claim 1 wherein each one of the plurality of resistance springs is a spring positioned between the posterior structure and the anterior structure; wherein each one of the plurality of resistance springs resists the action of the plurality of rack and pinions as the plurality of rack and pinions encloses the protective structure around the head of the user; wherein each one of the plurality of resistance springs provides a counter force during the seating of the posterior structure against the anterior structure; wherein each of the individual resistance springs is a helical compression spring; wherein each of the individual resistance springs is positioned between the posterior mounting edge and the anterior mounting edge such that a resistive force is generated by each of the individual resistance springs as the posterior mounting edge presses against the anterior mounting edge; wherein the plurality of resistance springs are installed in a plurality of spring cavities; wherein each of the plurality of spring cavities is a negative space formed into the posterior structure through the posterior mounting edge; wherein each of the plurality of spring cavities is formed in the shape of a cylinder; wherein each of the plurality of spring cavities is sized such that a resistance spring selected from the individual resistance springs inserts into a spring cavity selected from the plurality of spring cavities; wherein each of the individual resistance springs is sized such that any resistance spring selected from the individual resistance springs will extend beyond the posterior mounting edge of the posterior structure after the selected resistance spring has been inserted into a spring cavity selected from the plurality of spring cavities.

* * * * *